United States Patent [19]

Meyer

[11] 4,202,170

[45] May 13, 1980

[54] COMBUSTION CHAMBER FOR GAS TURBINES

[75] Inventor: Franz-Josef Meyer, Marbach, Fed. Rep. of Germany

[73] Assignee: Daimler-Benz Aktiengesellschaft, Fed. Rep. of Germany

[21] Appl. No.: 865,727

[22] Filed: Dec. 29, 1977

[30] Foreign Application Priority Data

Dec. 29, 1976 [DE] Fed. Rep. of Germany ..... 2659351

[51] Int. Cl.[2] ..... F02C 7/22; F02C 9/14

[52] U.S. Cl. ..... 60/39.23; 60/39.29; 60/749

[58] Field of Search ..... 60/39.23, 39.27, 39.29, 60/39.74 R; 239/408, 410; 431/90

[56] References Cited

U.S. PATENT DOCUMENTS

| | | | |
|---|---|---|---|
| 1,616,335 | 2/1927 | Rochefort | 239/410 |
| 3,975,900 | 8/1976 | Pfefferle | 60/39.23 |
| 3,986,347 | 10/1976 | Schirmer | 60/39.23 |
| 4,044,549 | 8/1977 | Zwick | 60/39.23 |
| 4,078,377 | 3/1978 | Owens et al. | 60/39.23 |

FOREIGN PATENT DOCUMENTS

| | | | |
|---|---|---|---|
| 1136719 | 5/1957 | France | 60/39.29 |

*Primary Examiner*—Robert E. Garrett
*Attorney, Agent, or Firm*—Craig & Antonelli

[57] ABSTRACT

A combustion chamber for gas turbines with a variable inlet cross section for the primary air, whereby the inlet cross section is so varied in dependence on the fuel pressure determining the injection quantity that with an increasing or decreasing fuel pressure, the inlet cross section is increased or decreased.

8 Claims, 2 Drawing Figures

COMBUSTION CHAMBER FOR GAS TURBINES

Figure 1:
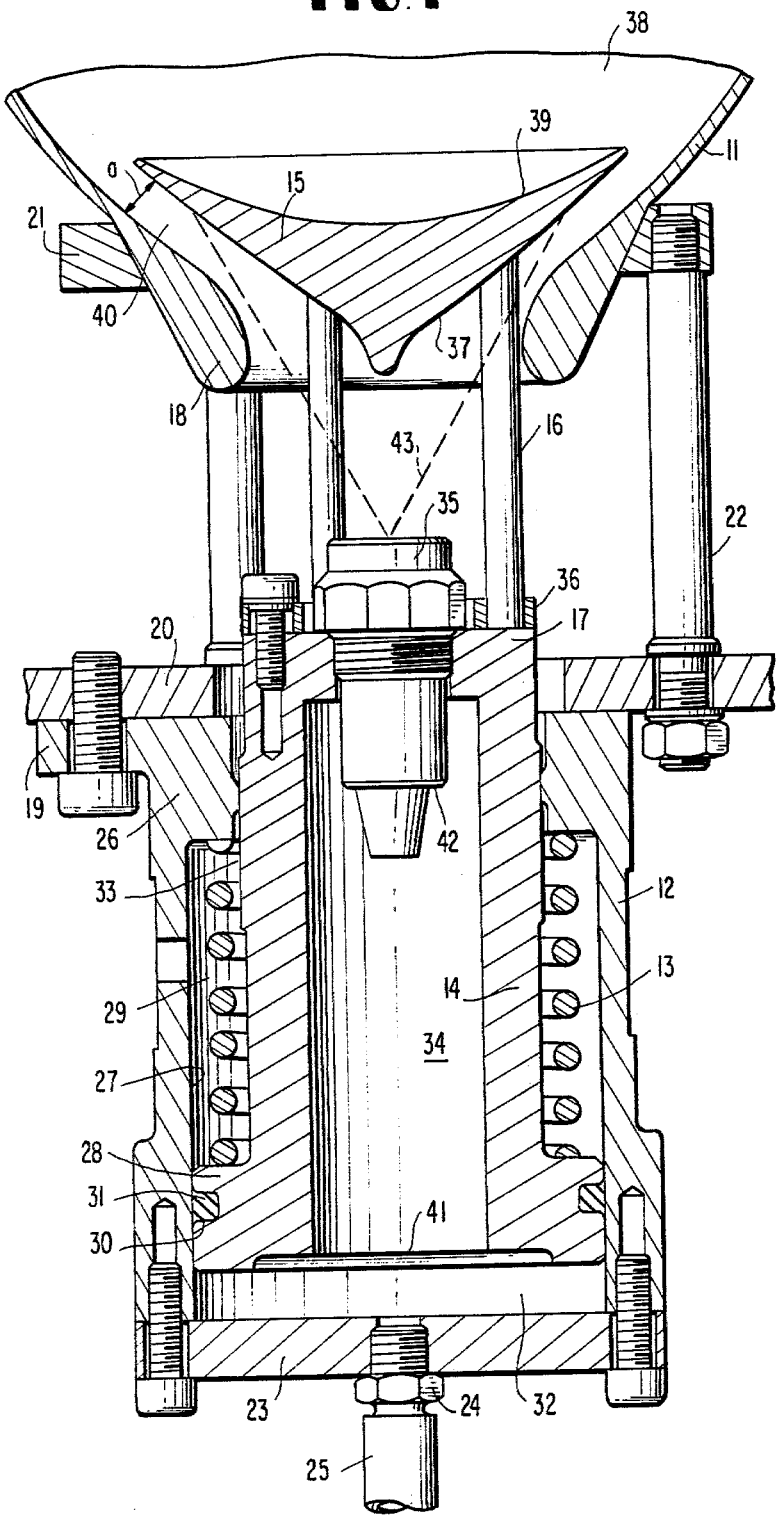

The present invention relates to a combustion chamber for gas turbines with a variable inlet cross section for the primary air. In a known combustion chamber of this type (German Offenlegungsschrift No. 1,815,695), the inlet cross section for the primary air is widened or narrowed, for example, by the longitudinal movement of a deflection body projecting into the inlet opening of the combustion chamber. The primary air supplied to the combustion chamber and therebeyond the remaining air components are thereby intended to be matched to the changing operating conditions.

The present invention is concerned with the task to always so meter the quantity of the primary air supplied to the combustion chamber during the operation of the gas turbine that a combustion of the fuel results which is as economic and as free of harmful substances as possible. The underlying problems are solved according to the present invention in that the inlet cross section is so varied in dependence on the fuel pressure determining the injection quantity that with an increasing or decreasing fuel pressure, the inlet cross section is increased or decreased, respectively. The matching of the primary air quantity to the injected fuel quantity achieved thereby enables an optimum mixing ratio in the primary zone of the combustion chamber and a correspondingly good combustion over the entire operating range of the gas turbine.

According to one advantageous construction of the present invention, an adjusting cylinder is connected with the fuel line leading to the injection nozzle, whose spring-loaded adjusting piston is connected with an adjusting member for changing the inlet cross section. As a result of this measure, the fuel pressure is utilized directly for the change of the inlet cross section for the primary air. Additional control members such as electronically controlled adjusting motors and the like are not required. This results in an adjusting mechanism constructed in a simple manner and operating reliably.

If the utilized fuel is not suitable as working medium, according to another construction of the present invention, one chamber of a hydraulic pressure-transmitting element having two mutually separated chambers may be connected with the fuel line leading to injection nozzle, whereby a hydraulic line leads from the other chamber thereof to an actuating cylinder, whose spring-loaded adjusting piston is connected with an adjusting member for changing the inlet cross section. In this manner, an identical or similar adjusting mechanism can be utilized also in the aforementioned case by a simple structural addition without impairing its effect.

Accordingly, it is an object of the present invention to provide a combustion chamber for gas turbines which avoids by simple means the aforementioned shortcomings and drawbacks encountered in the prior art.

Another object of the present invention resides in a combustion chamber for gas turbines in which a combustion of the fuel is obtained that is as economical as possible and as low in harmful substances as possible.

A further object of the present invention resides in a combustion chamber for gas turbines in which the quantity of the primary air supplied to the combustion chamber is matched optimally during all operating conditions of the gas turbine.

A still further object of the present invention resides in a combustion chamber for gas turbines which enables a desired matching of the primary air quantity to the injected fuel quantity under all operating conditions.

Another object of the present invention resides in a combustion chamber for gas turbines which enables an optimum mixture ratio in the primary zone of the combustion chamber and a correspondingly good combustion over the entire operating range of the gas turbine.

A still further object of the present invention resides in a combustion chamber for gas turbines which is simple in construction and obviates the need for complicated control and adjusting mechanisms.

Figure 2:
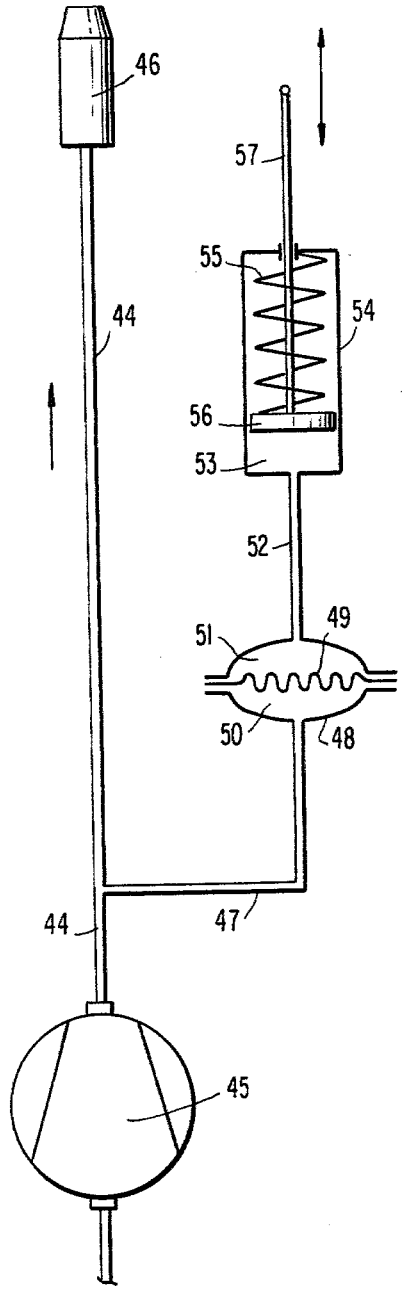

These and further objects, features and advantages of the present invention will become more apparent from the following description when taken in connection with the accompanying drawing which shows, for purposes of illustration only, two embodiments in accordance with the present invention, and wherein:

FIG. 1 is a longitudinal cross-sectional view through an adjusting mechanism for a combustion chamber in accordance with the present invention; and FIG. 2 is a schematic view of a modified embodiment of an adjusting mechanism in accordance with the present invention.

Referring now to the drawings wherein like reference numerals are used throughout the two views to designate like parts, the adjusting mechanism illustrated in FIG. 1 serves for changing the inlet cross section for the primary air supplied to the combustion chamber 11 of a motor vehicle gas turbine. The adjusting mechanism consists of an adjusting cylinder 12, in which is arranged an adjusting piston 14 spring-loaded by a compression spring 13 and of a deflection member 15 which is secured by means of rods 16 at the end wall 17 of the adjusting piston 14. The deflection member 15 is disposed inside of the combustion chamber 11 within the area of the axial inlet opening 18 for the primary air supplied to the combustion chamber, which inlet opening becomes wider in a funnel-shaped manner.

This adjusting cylinder 12 is threadably connected at a flange 19 thereof with a wall 20 of the gas turbine, on which a retaining ring 21 of the combustion chamber 11 is also secured by bolts 12. The adjusting cylinder 12 is closed off at its side opposite the wall 20 by means of a cover 23. A nipple 24 is screwed into the cover 23, to which the fuel line 25 is connected. A step or shoulder 26 at the inside 27 of the adjusting cylinder 12 and a collar 28 at the adjusting piston 14 contribute to the formation of an annular space 29, in which the compression spring 13 constructed as coil spring is accommodated in a space-saving and protected manner. The compression spring 13 is supported at the step 26 of the adjusting cylinder 12 and thereby presses the adjusting piston 14 at its collar 28 in the direction toward the cover 23.

The adjusting piston 14 abuts with its collar 28 at the inside 27 of the adjusting cylinder 12. A sealing ring 31 inserted into a groove 30 provided in the collar 28 seals off the cylinder space 32. The adjusting piston 14 additionally abuts with its ring-shaped guide surface 33 at the step 26 of the adjusting cylinder 12. The adjusting piston 14 includes a hollow space 34 which passes over into the cylinder space 32. An injection nozzle 35 is screwed into the end wall 17 of the adjusting piston 14, which is in communication with the fuel line 25 by way of the hollow space 34 and by way of the cylinder space 32. Additionally, a support ring 36 for the rods 16 which serve for the fastening of the deflection body 15, is threadably secured at the end wall 17.

The deflection body 15 has essentially the configuration of a flat cone. The surface 37 of the deflection member 15 which is directed against the primary air flowing into the combustion chamber 11, is curved favorable from a streamlining point of view. Its back side 39 facing the combustion space 38 of the combustion chamber 11 has a concave curvature for the formation of an annular swirl. The deflection member 15 forms together with the inlet opening 18 which also has a streamlined profile, an annular channel 40, whose inlet cross section is variable by the longitudinal movement of the deflection member 15. The gap width of the annular channel 40 which determines the inlet cross section is designated by reference character a.

The injection nozzle 35 is constructed as pressure-atomizing nozzle, with which the injection quantity depends from the fuel pressure and is controlled by the same. With a low pressure, the injected fuel quantity is small whereas with a high pressure, it is large. The pressure of the fuel which is fed to the injection nozzle 35 by way of the cylinder space 32 and the hollow space 34 acts on the end surfaces 41 and 42 of the adjusting piston 14 and of the injection nozzle 35. Depending on the prevailing fuel pressure, the adjusting piston 14 is axially displaced more or less far against the pressure of the compression spring 13 until the forces exerted by the fuel and by the compression spring 13 are in equilibrium. The deflection member 15 which is secured at the adjusting piston 14 by means of rods 16 is thereby displaced more or less far into the inlet opening 18 of the combustion chamber 11 whereby the inlet cross section of the annular channel 40 changes with the gap width a. Thus, for example, a high fuel pressure leads, on the one hand, to a larger injection quantity of the injection nozzle 35 and, on the other, to a large longitudinal displacement of the adjusting piston 14 in the direction toward the combustion chamber 11 and therewith to a large inlet cross section of the annular channel 40. As a result thereof the quantity of the primary air is automatically matched to the injected fuel quantity so that an optimum mixing ratio and therewith a combustion of the mixture results in the combustion chamber 11 which is as complete as possible and as free of harmful substances as possible. Similarly, with a small injection quantity effected by a lower fuel pressure, the inlet cross section of the annular channel 40 is correspondingly reduced and therewith the proportion of the primary air flowing into the combustion chamber 11 is so far reduced that again a favorable mixing ratio is produced.

The thorough mixing of fuel and primary air is considerably enhanced by the arrangement of the injection nozzle 35 at the adjusting piston 14. Since with this arrangement, the distance of the injection nozzle 35 from the deflection body 15 does not change, a favorable position of the fuel jet 43 indicated in the drawing by dash lines with respect to the deflection member 15 is maintained also with the adjustment thereof.

The adjusting path of the adjusting piston 14 which depends on the fuel pressure and therewith on the fuel quantity can be influenced by the selection of the spring which spring loads the adjusting piston 14. Thus, by the use of spring elements with progressive, linear or degressive characteristics, the adjusting path of the adjusting piston 14 and therewith the inlet cross section for the primary air can be matched advantageously to the injection characteristics of the injection nozzle 35.

In the adjusting arrangement schematically illustrated in FIG. 2, a fuel line 47 branches off from the fuel line 44 which connects the fuel pump 45 with the injection nozzle 46; the fuel line 47 leads to a diaphragm box or cell 48. A diaphragm 49 separates the diaphragm box 48 into the chambers 50 and 51. The chamber 50 is connected with the fuel line 47 whereas the chamber 51 is connected by way of a line 52 filled with hydraulic oil with the cylinder space 53 of an adjusting cylinder 54. An adjusting piston 56 in the adjusting cylinder 54 spring-loaded by a compression spring 55 is provided with a piston rod 57 to which is secured an adjusting member (not shown) for changing the inlet cross section for the primary air of a combustion chamber.

The diaphragm 49 transmits the pressure prevailing in the fuel lines 44 and 47 as well as in the chamber 50 to the hydraulic oil present in the chamber 51, in the line 52 and in the cylinder space 53. As a result thereof, pressure changes of the fuel influence the adjusting member by way of the diaphragm box 48 and the adjusting cylinder 54 so that, for example, with a higher fuel pressure and with a correspondingly larger injection quantity, more primary air is supplied to the combustion chamber. The operation of this embodiment is thus in principle the same as in the embodiment according to FIG. 1. However, it offers the advantage that fuel not suitable as working medium is kept away from the adjusting mechanism.

While I have shown and described only two embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A combustion chamber for gas turbines of the type having a variable inlet cross-section for primary air comprising:

(a) a turbine combustion chamber inlet means for admitting a supply of fuel and primary air to a turbine combustion chamber;

(b) a fuel injection nozzle means for injecting fuel through said inlet means;

(c) fuel supply means for supplying fuel to said nozzle means;

(d) inlet adjustment means exposed to fuel pressure in said supply means for adjusting the cross-sectional area of said inlet means so as to achieve a matching of primary air quantity to fuel quantity supplied to the combustion chamber in dependence upon said fuel pressure.

2. A combustion chamber according to claim 1, wherein said adjustment means comprises:

an adjusting cylinder means operatively connected with a fuel line of said supply means leading to the injection nozzle means and a spring-loaded adjusting piston means in said adjusting cylinder means, said piston means being operatively connected to an adjustment member for changing the cross-sectional area of the inlet means.

3. A combustion chamber according to claim 2, wherein the adjusting piston means is a hollow cylinder, and said injection nozzle means is mounted to an end wall thereof.

4. A combustion chamber according to claim 3, wherein said inlet means comprises an annular channel defined by an inlet portion of the combustion chamber and a deflection member adjustably positioned within said combustion chamber, said deflection member forming part of said adjustment means and being retained at a constant distance relative to said injection nozzle means.

5. A combustion chamber according to claim 2, wherein the adjusting cylinder means surrounds the adjusting piston means with an annular space formed therebetween, a compression spring being arranged in said annular space and supported against a spring abutment of the adjusting cylinder means at one end and a collar of the adjusting piston means at another end.

6. A combustion chamber according to claim 2, wherein said adjustment means comprises a hydraulic pressure-transmitting means having two chambers separated from one another, one of said chambers being operatively connected with the fuel line of said supply means leading to the injection nozzle means, and a hydraulic line leading from the other chamber to the adjusting cylinder means.

7. A combustion chamber according to claim 1, wherein said inlet means comprises an annular channel defined by an inlet portion of the combustion chamber and a deflection member adjustably positioned within said combustion chamber, said deflection member forming part of said adjustment means and being retained at a constant distance relative to said injection nozzle means.

8. A combustion chamber according to claim 7, wherein the adjusting cylinder means surrounds the adjusting piston means with an annular space formed therebetween, a compression spring being arranged in said annular space and supported against a spring abutment of the adjusting cylinder means at one end and a collar of the adjusting piston means at another end.

* * * * *